US006098247A

United States Patent [19]

Santelli, Jr.

[11] Patent Number: 6,098,247

[45] Date of Patent: Aug. 8, 2000

[54] PLASTIC EXTRUSION HAVING UNITARY THERMOPLASTIC RUBBER AND THERMOPLASTIC SECTIONS

[76] Inventor: Albert Santelli, Jr., 123 N. Mountain Ave., Bound Brook, N.J. 08805

[21] Appl. No.: 09/120,422

[22] Filed: Jul. 22, 1998

[51] Int. Cl.[7] ..... E05D 1/00

[52] U.S. Cl. ..... 16/225; 16/DIG. 13

[58] Field of Search ..... 16/225, DIG. 13, 16/385; 49/383, 397; 160/231.1, 231.2, 229.1

[56] References Cited

U.S. PATENT DOCUMENTS

| | | | |
|---|---|---|---|
| 3,128,120 | 4/1964 | Fournier et al. | 160/231.1 |
| 3,326,268 | 6/1967 | Dixon | 16/225 |
| 3,441,975 | 5/1969 | Shepherd | 16/225 |
| 3,516,114 | 6/1970 | Joyce | 16/225 |
| 4,828,132 | 5/1989 | Francis, Jr. et al. | 16/225 |
| 5,133,108 | 7/1992 | Esnault | 16/225 |
| 5,450,694 | 9/1995 | Goranson et al. | 16/225 |
| 5,539,955 | 7/1996 | Wiese | 16/225 |

*Primary Examiner*—Chuck Y. Mah

*Attorney, Agent, or Firm*—Paul A. Schwarz; Buchanan Ingersoll

[57] ABSTRACT

An improved extrusion having a flexible section of thermoplastic rubber, a substantially rigid section of thermoplastic unitary with the flexible section at a juncture of the sections, and tongue and groove means for increasing the surface area of the juncture. The extrusion can further have at least a second substantially rigid section of thermoplastic unitary with the flexible section at a second juncture and a second tongue and groove means for increasing the surface area of the second juncture.

9 Claims, 2 Drawing Sheets

PLASTIC EXTRUSION HAVING UNITARY THERMOPLASTIC RUBBER AND THERMOPLASTIC SECTIONS

FIELD OF INVENTION

This invention relates to plastic extrusions, and in particular, to a plastic extrusion comprising a flexible section of thermoplastic rubber unitary with one or more rigid sections of thermoplastic.

BACKGROUND OF THE INVENTION

Plastic extrusions having flexible elements are used for making a variety of structures such as hinges or weather-stripping. Such extrusions typically comprise a thin flexible section adjoining two thicker, fairly rigid sections which may be fastened or affixed to other structures. The entire extrusion is commonly made from polypropylene material.

These extrusions, however, have been less than adequate when subjected to a large number of flexure cycles, especially in low temperature environments. This is because the thin flexible section usually fails by fatiguing or tearing away from one of the rigid sections.

An attempt has been made to address this flexure cycle problem in U.S. Pat. No. 4,563,381. This patent discloses an extrusion comprising a flexible section made from a polyester elastomer extruded in tandem (coextruded) with at least one semi-rigid section of a thermoplastic material. During the coextrusion process, the end surfaces of the flexible section bond to surfaces of the rigid sections.

Unfortunately, the thin flexible section tends to peel away from the rigid sections when subjected to repeated flexing. Accordingly, there is still a need for an improved extrusion having a thin flexible section that is securely connected to one or more rigid sections.

SUMMARY OF THE INVENTION

An improved extrusion comprises a flexible section of thermoplastic rubber, a substantially rigid section of thermoplastic unitary with the flexible section at a juncture of the sections, and tongue and groove means for increasing the surface area of the juncture. The extrusion can further comprise at least a second substantially rigid section of thermoplastic unitary with the flexible section at a second juncture and a second tongue and groove means for increasing the surface area of the second juncture.

BRIEF DESCRIPTION OF THE DRAWINGS

The advantages, nature and various additional features of the invention will appear more fully upon consideration of the illustrative embodiments described in detail below, considered together with the accompanying drawings. In the drawings.

It should be understood that the drawings are for purposes of illustrating the concepts of the invention and are not to scale.

DETAILED DESCRIPTION OF THE INVENTION

Figure 1:
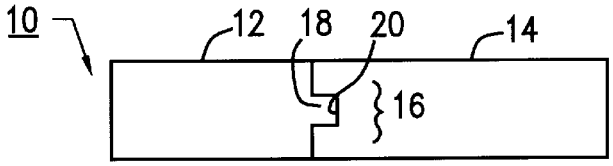
FIG. 1 is an elevational view of an extrusion according to the present invention.

FIG. 1 shows a plastic extrusion 10 according to the present invention. The plastic extrusion 10 comprises an elongated flexible section 12 of thermoplastic rubber that is unitary with an elongated planar rigid section of thermoplastic 14. The unitary juncture of the two sections 12, 14 is configured in a tongue and groove arrangement 16. The tongue and groove arrangement 16 substantially increases the contact or bonding surface area at the juncture of the flexible and rigid sections 12, 14 thereby improving the shear strength of the bond therebetween. Moreover, the since the flexible section 12 is made from a flexible material, it does not have to be made thinner than the rigid section 14 in order to be flexible.

The extrusion 10 shown in FIG. 1 can be used as a weather strip. In this application the rigid section 14 can be used for attaching the extrusion to a first structure such as a door (not shown) and the flexible section 12 can be used as a seal against another structure such as a door jamb (not shown).

The extrusion 10 is made by coextruding the flexible and rigid sections 12, 14 from the same die (not shown). This involves introducing hot liquefied thermoplastic rubber into the section of the die where the flexible section is formed at the same time that hot liquefied plastic is introduced into the section of the die where the rigid section is formed. The tongue and groove shaped juncture where the liquified rubber of the flexible section and the liquefied plastic of the rigid section meet in the die bond together and becomes unitary when the sections are cooled as the extrusion is extruded from the die.

Figure 2:
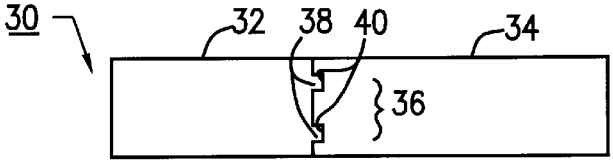
FIG. 2 is an elevational view of a second type of extrusion according to the present invention.
Figure 3A:
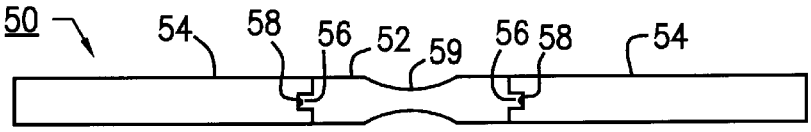
FIGS. 3A–3D are elevational views of other types of extrusions made according to the present invention.
Figure 3B:
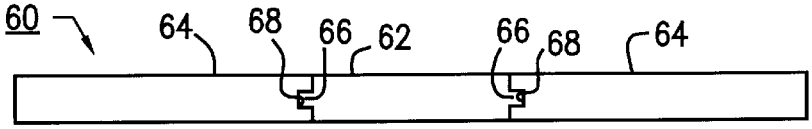
Figure 3C:
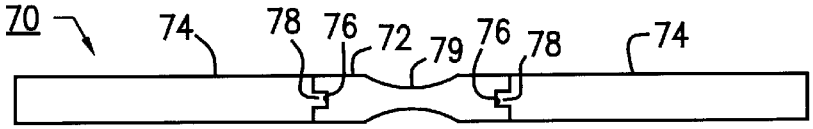
Figure 3D:
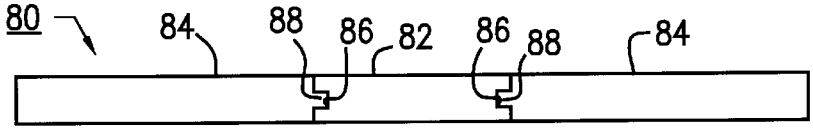

The tongue and groove arrangement 16 can take many forms. In FIG. 1, the arrangement 16 includes a tongue or projection 18 extending from the flexible section 12 and a corresponding groove 20 defined in the rigid section 14. FIG. 2 shows an extrusion 30 having a tongue and groove arrangement 36 that includes two tongues 38 extending from the bonding surface of the flexible section 32 and two corresponding grooves 40 defined in the bonding surface of the rigid section 34.

FIGS. 3A–3D show various types of extrusions 50, 60, 70, 80 embodying the principles of the present invention. These extrusions are especially useful as hinges. Each of the extrusions 50, 60, 70, 80 shown in FIGS. 3A–3D comprises an elongated flexible section 52, 62, 72, 82 of thermoplastic rubber that is unitary with two elongated planar rigid sections 54, 64, 74, 84 of plastic. The extrusions 50, 60 shown in FIGS. 3A and 3B have tongues 56, 66 extending from the flexible sections 52, 62 and grooves 58, 68 defined in the rigid sections 54, 64. The extrusions shown in FIGS. 3C and 3D have tongues 78, 88 on the rigid sections 74, 84 and grooves 76, 86 in the flexible sections 72, 82. Although not shown, combinations of tongues and grooves can be provided on each of the sections if desired.

The flexibility of the flexible section can be increased if desired by reducing the cross-sectional area thereof. For example, the extrusions shown in FIGS. 3A and 3B, have flexible sections 52, 72 which have been made more flexible by providing tapers 59, 79 in the central regions thereof.

Figure 4A:
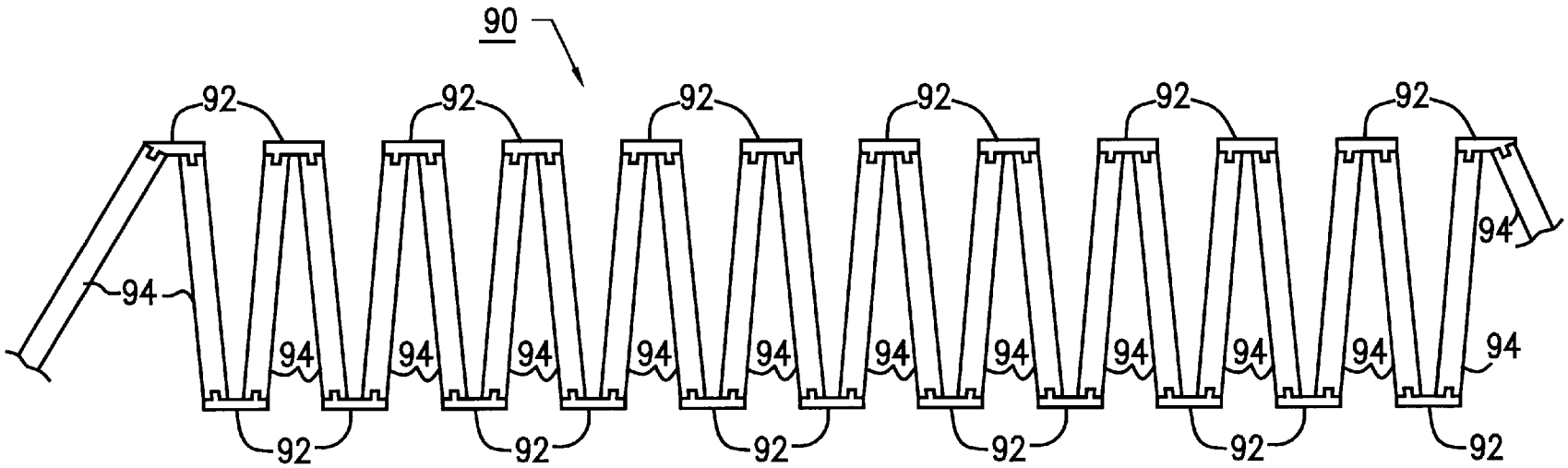
FIG. 4A is an elevational view of an extrusion configured as a folding panel.
Figure 4B:
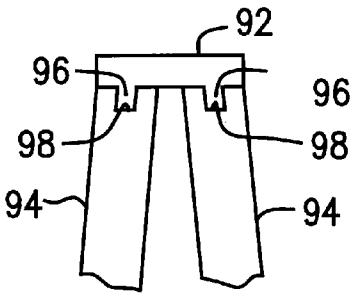
FIG. 4B is an enlarged view of a section of the extrusion of FIG. 4A.

FIG. 4A shows an extrusion 90 configured as a folding panel. The extrusion 90 comprises a plurality of elongate flexible sections 92 of thermoplastic rubber and plurality of planar rigid sections 94 of thermoplastic. Each flexible section 92 has two rigid sections 94 extending from and unitary with a side thereof. Tongues 96 and grooves 98 are provided at the junctures of the sections 92, 94 as best seen in FIG. 4B.

Figure 5:
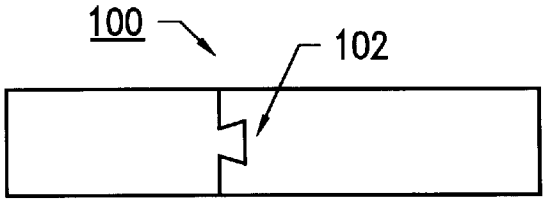
FIG. 5 is an elevational view of an extrusion having a tapered tongue and groove arrangement.

The tongue and groove arrangement of the extrusion can also provide mechanical interlocking of the sections. FIG. 5 shows an extrusion 100 having a "dove-tail" tapered tongue and groove arrangement 102. Mechanical interlocking can also be provided with a T-shaped tongue and correspondingly shaped groove (not shown).

The thermoplastic rubber forming the flexible section of the extrusion can be neoprene and the thermoplastic forming the rigid section of the extrusion can be polyethylene. Other materials can also be used such as those described in U.S. Pat. No. 4,563,381 which is incorporated herein by reference.

It will be understood that the embodiment described herein is merely exemplary and that a person skilled in the art may make many variations and modifications to the described embodiment utilizing functionally equivalent elements to those described. Any variations or modifications to the invention just described are intended to be included within the scope of the invention.

What is claimed is:

1. An extrusion comprising a coextruded member having a flexible section of thermoplastic rubber and a substantially rigid section of thermoplastic, the flexible section including at least a first element of a tongue and groove arrangement, the substantially rigid section of thermoplastic including at least a second element of the tongue and groove arrangement which is complimentary to and mates with the first element, the elements of the tongue and groove arrangement defining a bonded juncture having surfaces which are melted together during coextrusion of the flexible and substantially rigid sections.

2. The extrusion according to claim 1, wherein the at least first element of the flexible section includes a tongue element, and the at least second element of the substantially rigid section includes a groove element.

3. The extrusion according to claim 1, wherein the at least second element of the substantially rigid section includes a tongue element, and the at least first element of the flexible section includes a groove element.

4. The extrusion according to claim 1, further comprising at least a second substantially rigid section of thermoplastic, the flexible section of thermoplastic rubber further including at least a first element of a second tongue and groove arrangement, the second substantially rigid section of thermoplastic further including at least a second element of the second tongue and groove arrangement which is complimentary to and mates with the further first element of the second tongue and groove arrangement, the further elements of the second tongue and groove arrangement defining a second bonded juncture having surfaces which are melted together during coextrusion of the flexible and substantially rigid sections.

5. The extrusion according to claim 4, wherein the flexible section is disposed between the rigid sections.

6. The extrusion according to claim 5, wherein the extrusion comprises a hinge.

7. The extrusion according to claim 4, wherein the rigid sections extend from a side of the flexible section.

8. The extrusion according to claim 7, wherein the extrusion comprises a hinge.

9. The extrusion according to claim 4, wherein the rigid sections extend from opposite sides of the flexible member.

* * * * *

UNITED STATES PATENT AND TRADEMARK OFFICE

CERTIFICATE OF CORRECTION

PATENT NO. : 6,098,247

DATED : August 8, 2000

INVENTOR(S) : Santelli, Jr.

It is certified that error appears in the above-indentified patent and that said Letters Patent is hereby corrected as shown below:

On the Title Page

Please insert the following information in Section [56] (References Cited):

| | | | |
|---|---|---|---|
| – | 3,019,486 | 2/62 | Stinson – |
| – | 3,889,736 | 6/75 | Firks – |
| – | 4,131,971 | 1/79 | Saarloos – |
| – | 4,296,524 | 10/81 | Horholt et al. – |
| – | 4,563,381 | 1/86 | Woodland – |
| – | 4,775,121 | 10/88 | Carty – |
| – | 4,860,495 | 8/89 | Kessler – |
| – | 5,115,855 | 5/92 | Lindblom et al. – |
| – | 5,148,850 | 9/92 | Urbanick – |
| – | 5,235,136 | 8/93 | Santucci et al. – |
| – | 5,265,308 | 11/93 | May et al. – |
| – | 5,419,134 | 5/95 | Gibson – |
| – | 5,459,900 | 10/95 | Mege et al. – |
| – | 5,486,392 | 1/96 | Green – |

Signed and Sealed this

Tenth Day of April, 2001

*Attest:*

Nicholas P. Godici

NICHOLAS P. GODICI

*Attesting Officer*

*Acting Director of the United States Patent and Trademark Office*